US005581966A

United States Patent [19]

Fligg

[11] Patent Number: 5,581,966

[45] Date of Patent: Dec. 10, 1996

[54] APPARATUS FOR INSTALLING STRIPS OF INSULATION IN BUILDINGS

[76] Inventor: Robert E. Fligg, 2501 Jordan Grove, West Des Moines, Iowa 50265

[21] Appl. No.: 600,183

[22] Filed: Feb. 12, 1996

Related U.S. Application Data

[63] Continuation-in-part of Ser. No. 134,597, Oct. 12, 1993, Pat. No. 5,442,890, and Ser. No. 394,905, Feb. 27, 1995, Pat. No. 5,535,560.

[51] Int. Cl.[6] ..... E04B 1/74

[52] U.S. Cl. ..... 52/404.3; 52/404.5; 160/392

[58] Field of Search ..... 52/404.3, 404.5, 52/743, 408, 90.1; 160/391, 392

[56] References Cited

U.S. PATENT DOCUMENTS

| | | | |
|---|---|---|---|
| 3,355,203 | 11/1967 | Stauffer | 52/404.5 X |
| 3,513,614 | 5/1970 | Studzinski | 52/743 |
| 4,047,346 | 9/1977 | Alderman | 52/743 X |
| 4,075,807 | 2/1978 | Alderman | 52/743 X |
| 4,370,792 | 2/1983 | Watts | 160/392 X |
| 4,375,742 | 3/1983 | Paliwoda | 52/404.3 |
| 4,425,747 | 1/1984 | Player | 52/404.3 |
| 4,426,760 | 1/1984 | Watts | 160/392 X |
| 4,434,601 | 3/1984 | Zellmer . | |
| 4,446,664 | 5/1984 | Harkins | 52/404.3 |
| 4,446,665 | 5/1984 | Berger | 52/743 X |
| 4,573,298 | 3/1986 | Harkins | 52/404.3 X |
| 4,586,301 | 5/1986 | Hickman . | |
| 4,694,543 | 9/1987 | Conley . | |
| 4,724,651 | 2/1988 | Fligg . | |
| 4,817,655 | 4/1989 | Brooks . | |
| 4,856,247 | 8/1989 | Georgino | 52/404.3 |
| 5,085,023 | 2/1992 | Duffy | 52/90.1 X |
| 5,209,029 | 5/1993 | Foerst . | |
| 5,442,890 | 8/1995 | Fligg . | |

*Primary Examiner*—Carl D. Friedman
*Assistant Examiner*—Beth A. Aubrey
*Attorney, Agent, or Firm*—Henderson & Sturm

[57] ABSTRACT

A method of installing insulation under a pre-existing roof of a building of a type having a spaced apart structural beams standing in one direction under the roof and a plurality of spaced apart elongated purlins extending transversely to the structural beams and being supported by the structural beams. Purlin clips are used which connect to the purlins at the top and to a lower support member at the bottom thereof. The method includes installing an upper support member across from one to the other of an adjacent pair of purlins. An upper strip of insulation is positioned between adjacent pairs of purlins above the upper support member whereby the strip of insulation will be supported by the upper support member. A lower strip of insulation is attached at one end into one of the structural beams, under the upper layer of insulation, and to the other of the structural beams at the other end thereof. A lower support member is then attached between adjacent purlin clips and under the lower strip of insulation for supporting the under side of the lower strip of insulation. The upper support member or members are then removed so that the upper strip of insulation will move down and be supported on top of the lower strip of insulation.

4 Claims, 6 Drawing Sheets

APPARATUS FOR INSTALLING STRIPS OF INSULATION IN BUILDINGS

This is a continuation-in-part, of application Ser. No. 08/134,597, filed on Oct. 12, 1993, entitled INSTALLING INSULATION IN BUILDINGS, now U.S. Pat. No. 5,442,890, issued Aug. 22, 1995 and Ser. No. 08/394,905, filed on Feb. 27, 1995, entitled CONNECTING APPARATUS FOR USE IN INSTALLING INSULATION IN BUILDINGS now U.S. Pat. No. 5,538,860.

TECHNICAL FIELD

The present invention relates generally to an apparatus for installing insulation into the top of a building, and more particularly to such method which installs strips of fiberglass insulation into a building which already has the roof thereof installed.

BACKGROUND ART

It is, of course, well known that buildings must be insulated in order to retain heat or cold when the temperatures outside are very different from the desired temperature within the building. This is particularly a problem in metal buildings of a commercial type, since metal is a very good conductor of heat.

In order to install insulation in the ceiling of a metal building, it has become a common practice to insulate during the initial construction of the building and to provide the insulation in the top of the building before the final layer of the roof is put onto the building, for example, as shown in U.S. Pat. No. 4,346,543 to Wilson et al. One of the problems with this approach is that the installation of the insulation interferes with the construction of the building. Usually, different people do the insulation work, and since the speed of installing the building is typically very important, the insulation steps detract from the timeliness of construction. Consequently, there is a need to be able to insulate a building more quickly.

Another category of insulation problems relates to insulating a building which is already existing, or adding insulation to such existing building in order to increase the R-factor of the ceiling or walls. Especially since each existing building is somewhat different, there is no one approach that seems to be universally acceptable.

U.S. Pat. No. 4,724,651 to Fligg dealt with a similar problem, but the problem was solved by blowing loose insulation into the space between the purlins above a lower fiberglass matt. While there has been a desire by the inventor herein to replace the blown-in loose fiberglass material with a fiberglass matt, the problem has been a perplexing one until this present invention was developed.

DISCLOSURE OF THE INVENTION

The present invention relates to a method of installing insulation under a pre-existing roof of a building of a type having a spaced apart structural beams extending in one direction under the roof and a plurality of spaced apart elongated purlins extending transversely to the structural beams and being supported by the structural beams. Purlin clips are used which connect to the purlins at the top and to a lower support member at the bottom thereof.

The method includes installing an upper support member across from one to the other of an adjacent pair of purlins. An upper strip of insulation is positioned between adjacent pairs of purlins above the upper support member whereby the strip of insulation will be supported by the upper support member. A lower strip of insulation is attached at one end into one of the structural beams, under the upper layer of insulation, and to the other of the structural beams at the other end thereof. A lower support member is then attached between adjacent purlin clips and under the lower strip of insulation for supporting the under side of the lower strip of insulation. The upper support member or members are then removed so that the upper strip of insulation will move down, by gravity, and be supported on top of the lower strip of insulation.

Another aspect of the invention relates to the apparatus for attaching the ends of the lower strip of insulation to the structural beams and still another aspect of the invention relates to the apparatus for attaching the lower support members to the lower end of the purlin clips.

An object of the present invention is to provide a novel apparatus for attaching the lower end of the fiberglass insulation to a structural member at each end of the fiberglass mats.

Other objects, advantages, and novel features of the present invention will become apparent from the following detailed description of the invention when considered in conjunction with the accompanying drawings.

BEST MODE FOR CARRYING OUT THE INVENTION

Figure 1:
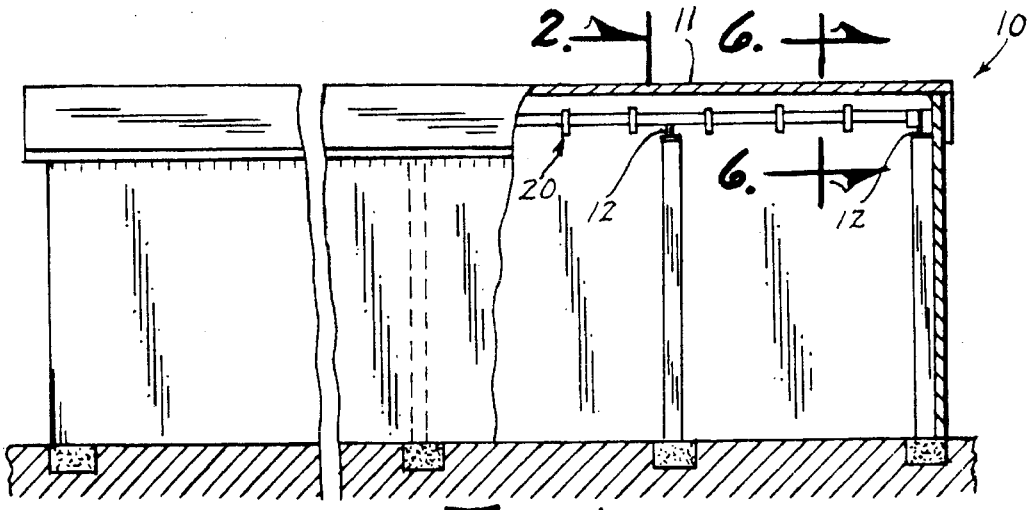
FIG. 1 is a side elevational view of a building to be insulated, having a portion thereof broken away to show the beams and purlins inside.
Figure 4:
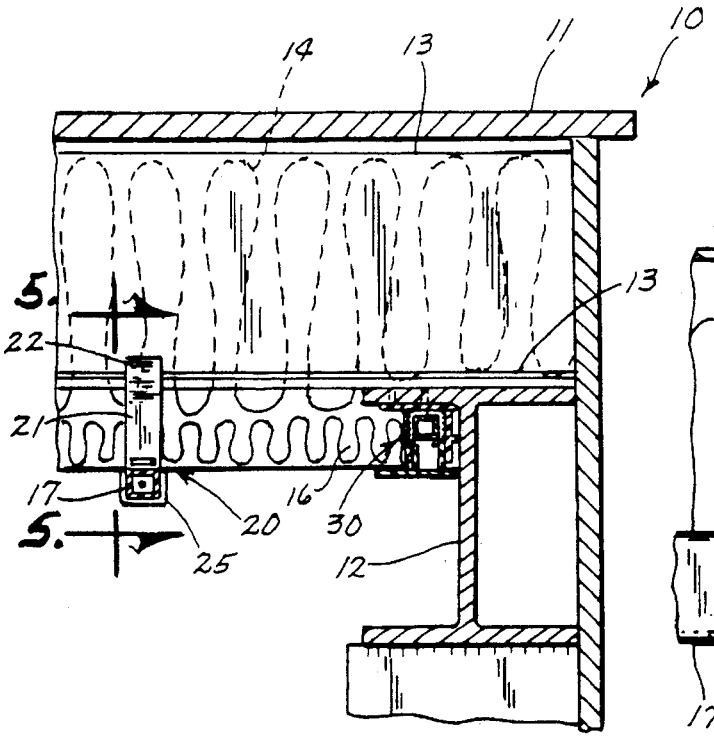
FIG. 4 is an enlarged cross sectional view taken along line 4—4 of FIG. 2 showing how the end I-beams support the purlins and how the insulation connector member purlin clips and support members are disposed after installation thereof.

Referring now to the drawings wherein like reference numerals designate identical or corresponding parts throughout the several views, FIG. 1 shows a building (10) having a roof (11) thereon of a type which can be insulated by the method and apparatus of the present invention. The building (10) includes structural beams (12) in FIGS. 1 and 4 for supporting purlins (13). These purlins (13) extend across the building from one beam (12) shown in FIG. 1 to another beam (12) which would be on the other end of the building, but covered up by the roof and sides of the building as shown in FIG. 1.

Figure 8:
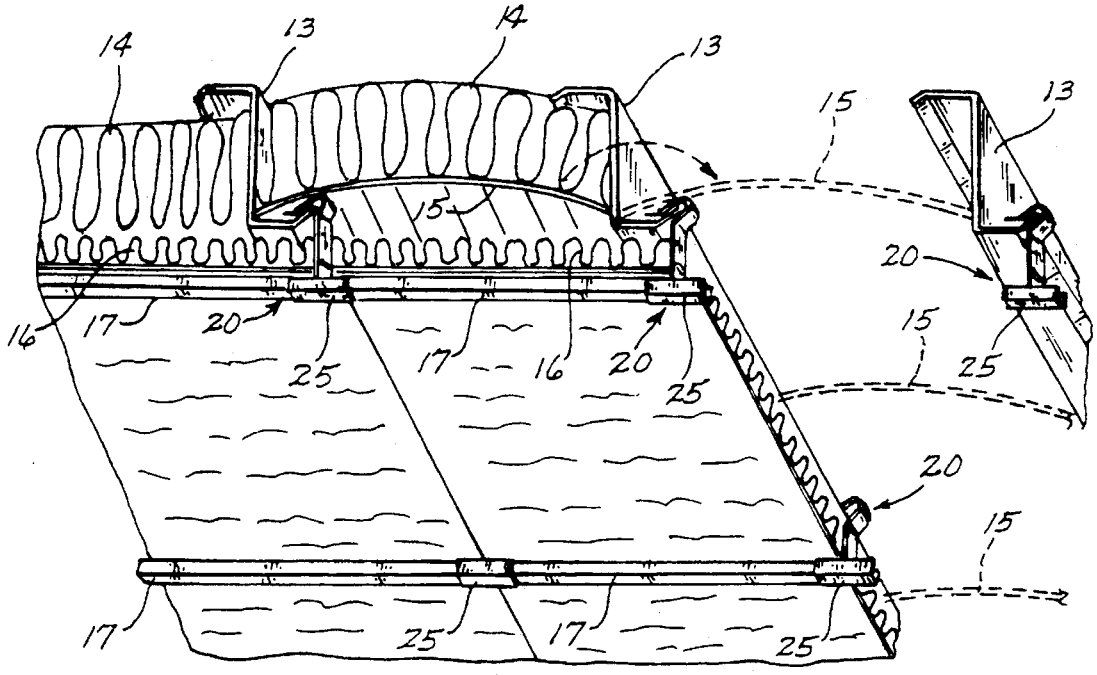
FIG. 8 is a perspective view of the structure referred to above in the process of installing the two layers of insulation.

In order to install fiberglass insulation shown in FIG. 8 into the building (10), a fiberglass mat (14) of insulation is first positioned between adjacent purlins (13) and about every three feet as the fiberglass mat (14) is unrolled, the installer will insert a semi-rigid, flexible rod (15) between the purlins (13). This flexible rod (15) can preferably be made of fiberglass or metal of a type which will bend to hold itself in place between the purlins (13), but will return to a straight configuration when removed from between the purlins (13). This upper support member (15) is then utilized to hold the upper strip of insulation (14) in place until a lower strip of insulation (16) can be installed.

Figure 9:
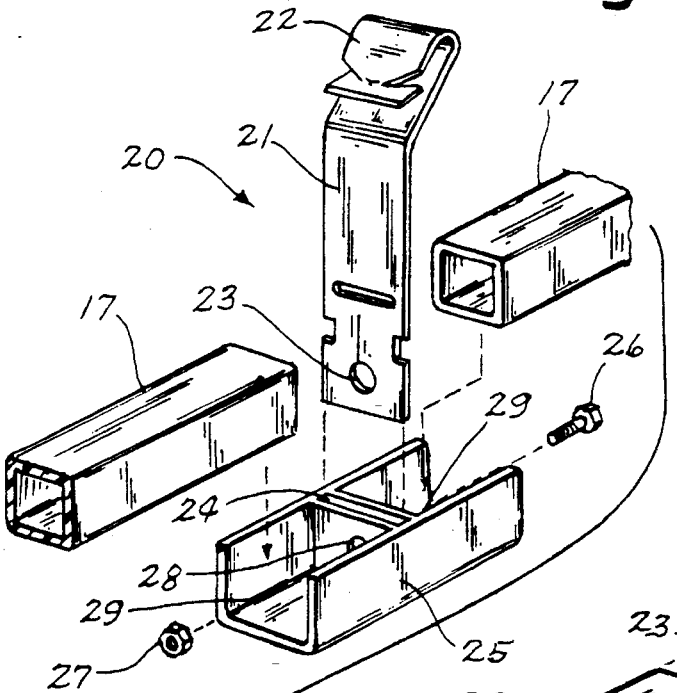
FIG. 9 is an enlarged perspective view of a purlin clip and its associated lower support members.

Purlin clips (20) shown in FIG. 9 can be hooked over the lip of each purlin (13) at predetermined intervals for the ultimate purpose of installing a lower support member (17).

Figure 3:
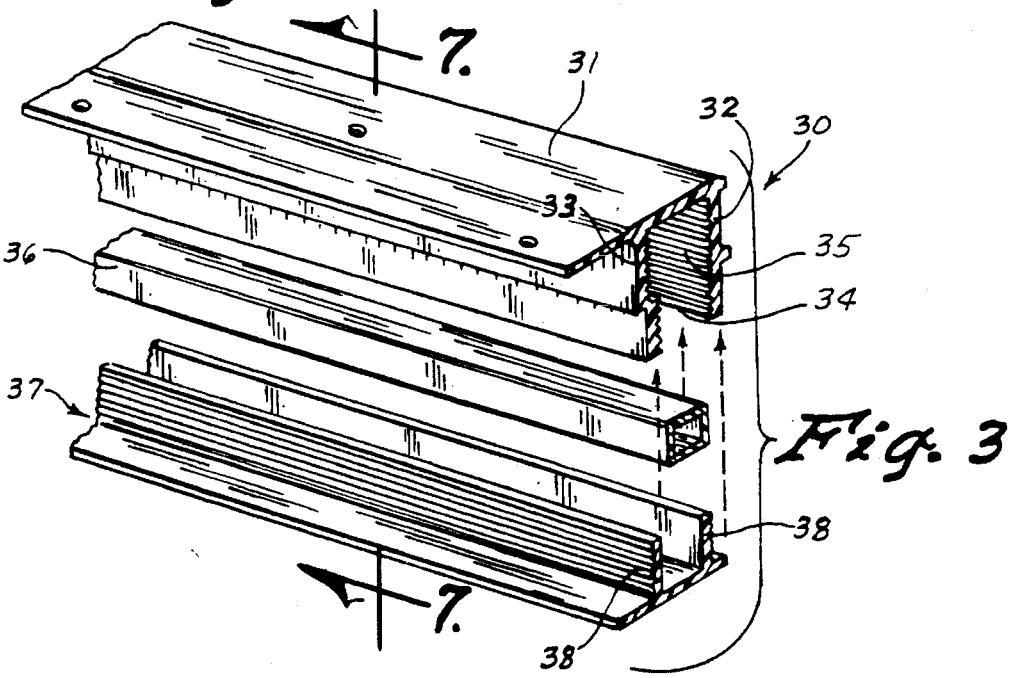
FIG. 3 is an exploded perspective view of a connecting apparatus for connecting the ends of the lower layer of insulation to the structural beams at each end of the building.
Figure 7:
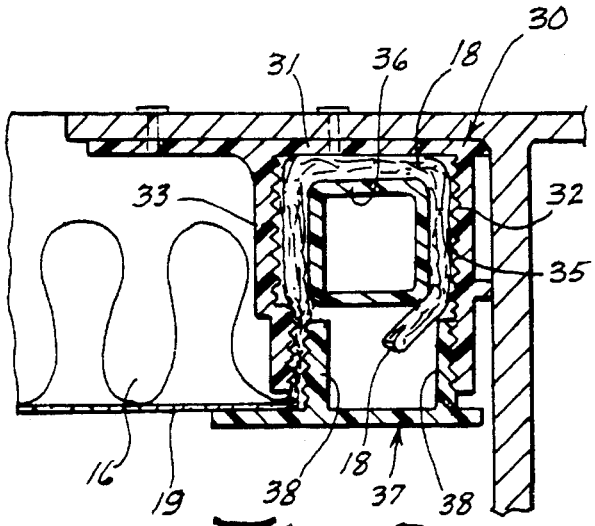
FIG. 7 is a cross sectional view taken along line 7—7 of FIG. 3 and also showing the structure connected to an I-beam and also in the position holding the end of the lower strip of insulation to the I-beam.

After the upper strip of insulation (14) is completely supported between adjacent purlins (13) as shown in FIG. 8, then the lower strip of insulation (16) is installed by first utilizing a connector (30) shown in FIGS. 3 and 7, for example. The connector (30) includes a base portion (31) having two spaced apart portions (32) and (33) forming a groove (34). The spaced apart portions (32) and (33) have longitudinal ridges (35) on the inside surface thereof and the portion (33) has a notched-out portion for receiving a support member (36) as can readily be seen in FIG. 7. If this notched-out portion (33) were not provided, then the holding member (36) would push the portions (32) and (33) apart instead of permitting the end (18) of the lower fiberglass mat (16) to extend around the holding member (36) and in the groove between leg portions (32) and (33).

The lower fiberglass mat (16) has a lower water impermeable facing (19) adhered thereto and this is all compressed into the groove (34) as shown in FIG. 7. Once the holding member (36) is installed to compress the end (18) of the insulation (16), a locking member (37) is pushed into the groove (34) as shown in FIG. 7 to lock the holding member (36) in place and provide an attractive trim for the end of the lower strip of insulation (16). This locking member (37) also has projecting portions (38) thereon and longitudinal projections on the outside thereof for cooperating with, and in some instances mating with, the longitudinal ridges and grooves inside of groove (34).

Referring to FIG. 8, it is noted that after the lower strip of insulation (16) is fully installed, the installer reaches up under the purlins and grasps the upper support members (15) and pulls them out under the purlin clips (13), to the right as shown in FIG. 8, and re-installs these upper support members (15) between the next adjacent pair of purlin clips, for example in the position of the dashed lines of upper support members (15) shown in FIG. 8. Then the upper strip of insulation (14) will fall down onto the lower strip of insulation, for example as in the far left part of FIG. 8. Then the process can continue by just continuing to install first the top layer (14) and then the bottom layer (16) of insulation between each and every adjacent pair of purlins (13).

Figure 5:
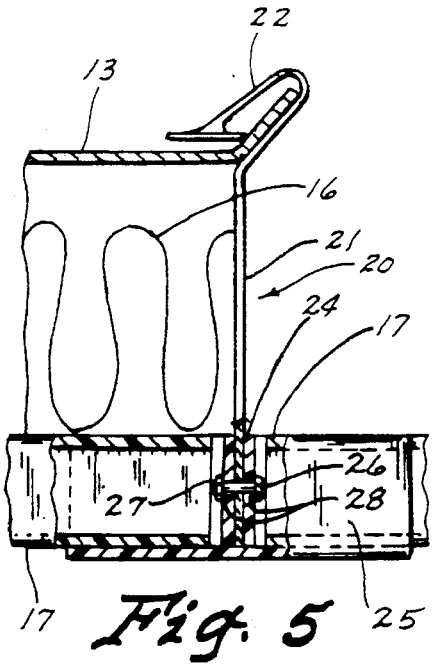
FIG. 5 is an enlarged cross sectional view taken along 5—5 of FIG. 4 showing the purlin clips and lower connector members for attaching the lower support members to hold the insulation in place.
Figure 6:
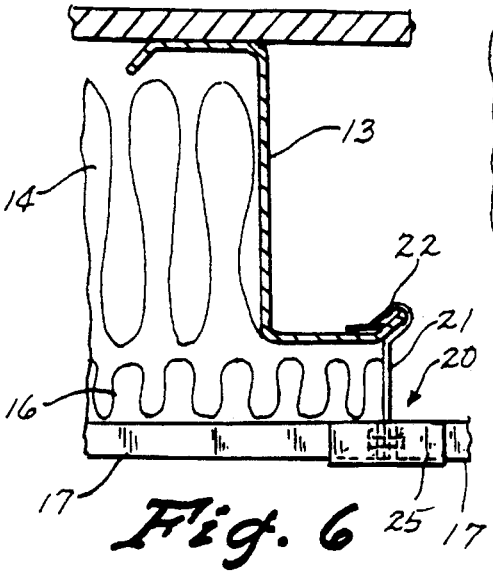
FIG. 6 is an enlarged cross sectional view taken along line 6—6 of FIG. 1.

Referring to FIG. 9, it is noted that purlin clip (20) includes a sheet metal portion (21) with a bend portion (22) on the top thereof for extending around a purlin as shown in FIG. 5. The lower portion of the purlin clip has a hole (23) therein and when the lower end of the clip (21) is received in an opening (24) in member (25), then a bolt (26) and nut (27) can be used to extend through and fasten the lower end of the purlin clip (21) because the bolt (26) extends through opening (28) and opening (23). Member (25) includes upwardly facing cavities (29) for receiving lower support members (17).

Figure 10:
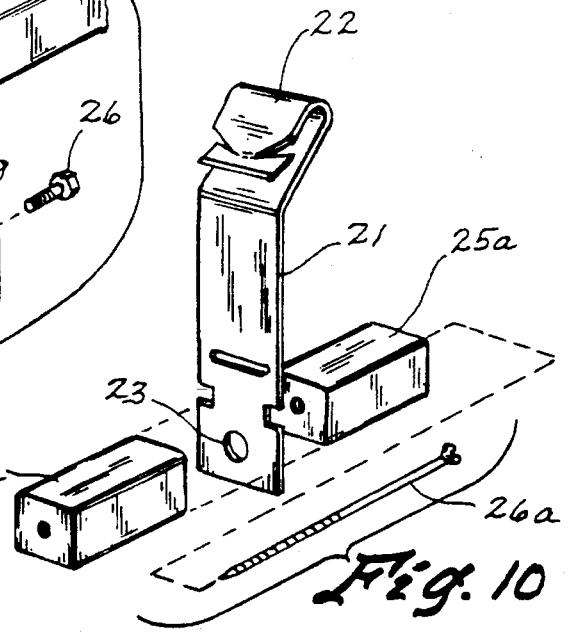
FIG. 10 is an alternate purlin clip and alternate lower support member attachment structure.

Alternatively, the purlin clip (21) with top (22) can be of the type shown in FIG. 10, having rectangular members (25*a*) attached thereto by a fastener (26*a*). Lower support member (17) merely telescope over the members (25*a*) rather than fitting into the cavity (29) as shown in FIG. 9.

In operation, an upper support member (15) is installed between purlins (13). Then the strip of insulation (14) is installed as indicated above by unrolling it, for example by using as a roll of matted fiberglass insulation. An upper support member (15) can be put in place just before the insulation (14) is rolled over that portion of the structure or several support members (15) can be installed before the fiberglass strip (14) is unrolled. The structural member (15) are continuously placed ahead of the unrolled fiberglass (14), perhaps every three foot or so between adjacent purlins (13).

Figure 2:
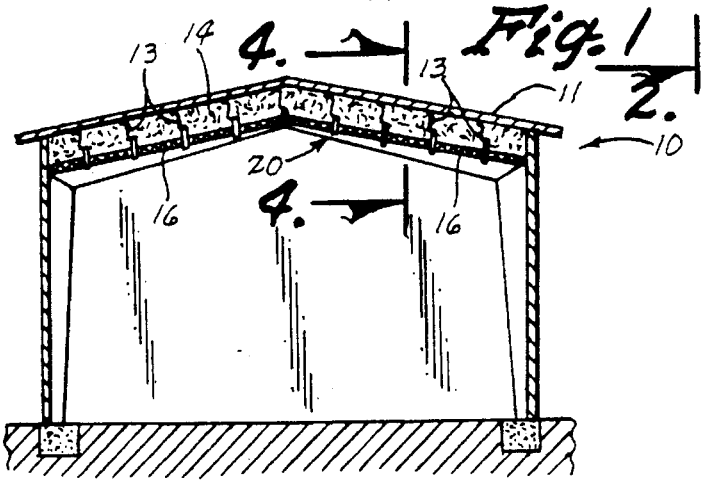
FIG. 2 is a cross sectional view taken along line 2—2 of FIG. 1 showing the building fully insulated.

Once the entire strip of insulation (14) goes from one side of the building (10) to the other between adjacent purlins (13), the lower strip of insulation (16) is installed by first attaching one end of the lower strip of fiberglass insulation (16) into the connector members (30) as shown in FIG. 7. Then the lower strip (16) is unrolled and is supported upwardly by placing lower support members (17) between adjacent purlin clips (20) as shown in FIG. 8, until the entire lower layer of insulation (16) has been installed from one end of the building to the other. Of course this can be done either lengthwise of the building or across the building if desired. In this case, it is done lengthwise of the building, because of the configuration of the building (10) shown in FIGS. 1 and 2.

After the lower strip of insulation (16) extends entirely across the building, then the other end of the strip of insulation (16) would be securely held in place by a structure which is essentially a mirror image of that shown in FIG. 7 by utilizing the connector members (30) shown in FIG. 3.

Figure 11:
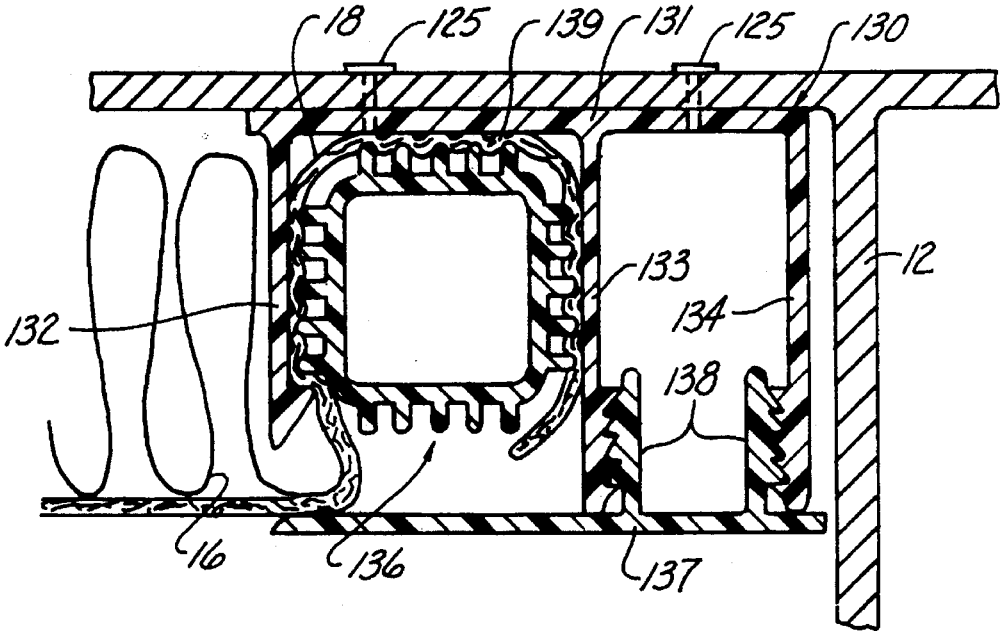
FIG. 11 is a cross-sectional view like FIG. 7 but showing an alternate structure for holding one end of the lower strip of insulation to the I-beam.
Figure 12:
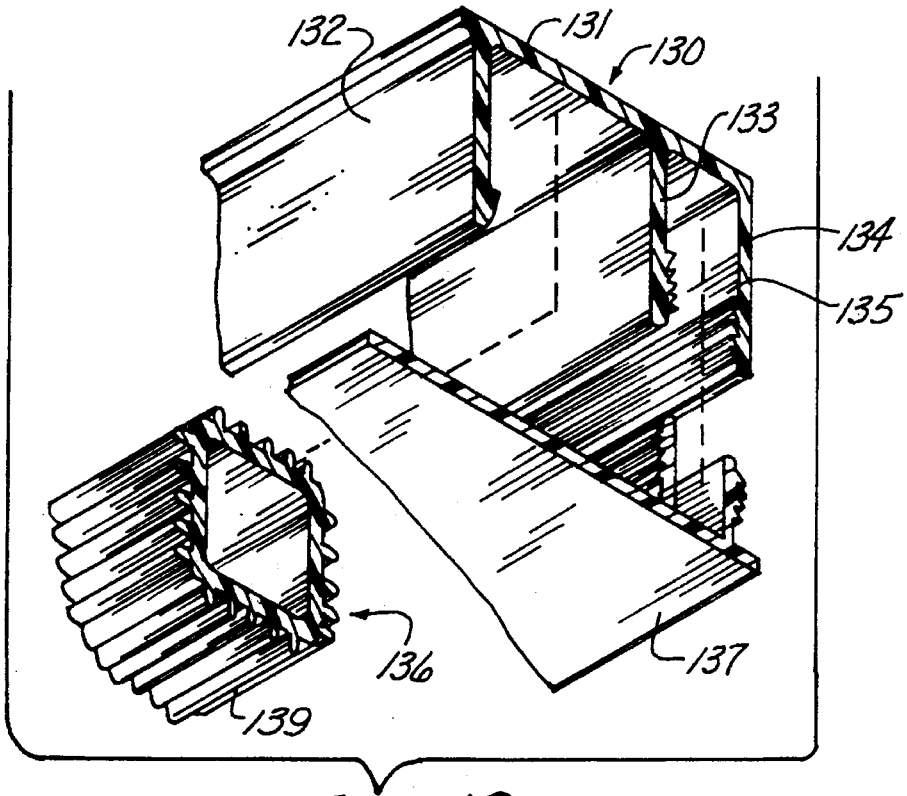
FIG. 12 is an exploded perspective view of the connecting structure of FIG. 11.

Referring now to FIGS. 11 and 12, a connector (130) similar to connector (30) of FIG. 7 is shown attached to an I-beam (12) by fasteners (125).

Figure 13:
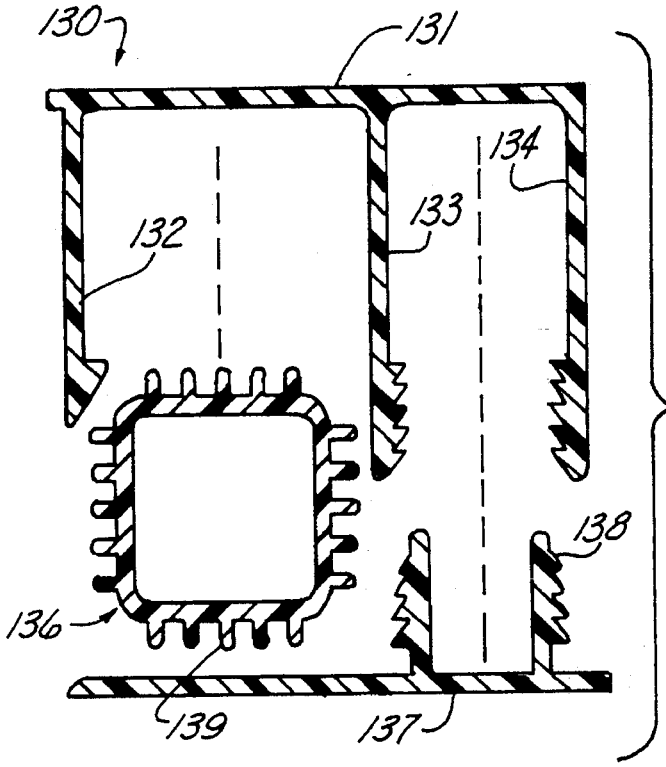
FIG. 13 is an exploded cross-sectional view of the connecting structure of FIGS. 11 and 12.

The lower strip of insulation (16) is installed by first utilizing a connector (130) shown in FIGS. 11, 12 and 13, for example. The connector (130) includes a base portion (131) having three spaced apart portions (132), (133) and (134) forming grooves between adjacent spaced about portions. The spaced apart portions (133) and (134) have longitudinal ridges (135) on the inside surface thereof. A support member (136), as can readily be seen in FIGS. 11 and 12 fits between portions (132) and (133) and has longitudinal ridges (139)

disposed thereon for gripping the insulation end (18). The lower fiberglass mat (16) extends around the holding member (136) and in the groove between leg portions (132) and (133).

The lower fiberglass mat (16) has a lower water impermeable facing (19) adhered thereto and this is all compressed into the groove between portions (132) and (133) as shown in FIG. 11. Once the holding member (136) is installed to compress the end (18) of the insulation (16), a member (137) is pushed into the groove between portions (133) and (134) as shown in FIG. 11 to provide an attractive trim for the end of the lower strip of insulation (16). This member (137) also has projecting portions (138) thereon and longitudinal projections on the outside thereof for cooperating with, and in some instances mating with, the longitudinal ridges and grooves (135) inside of groove between portions (133) and (134).

Figure 14:
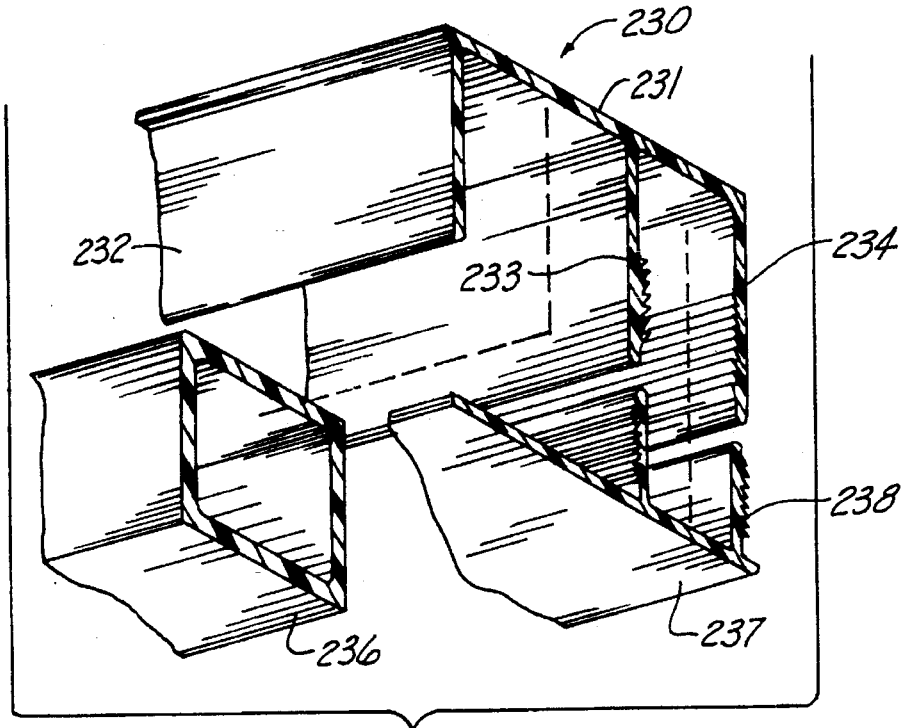
FIG. 14 is an exploded perspective view of still another connecting structure.
Figure 15:
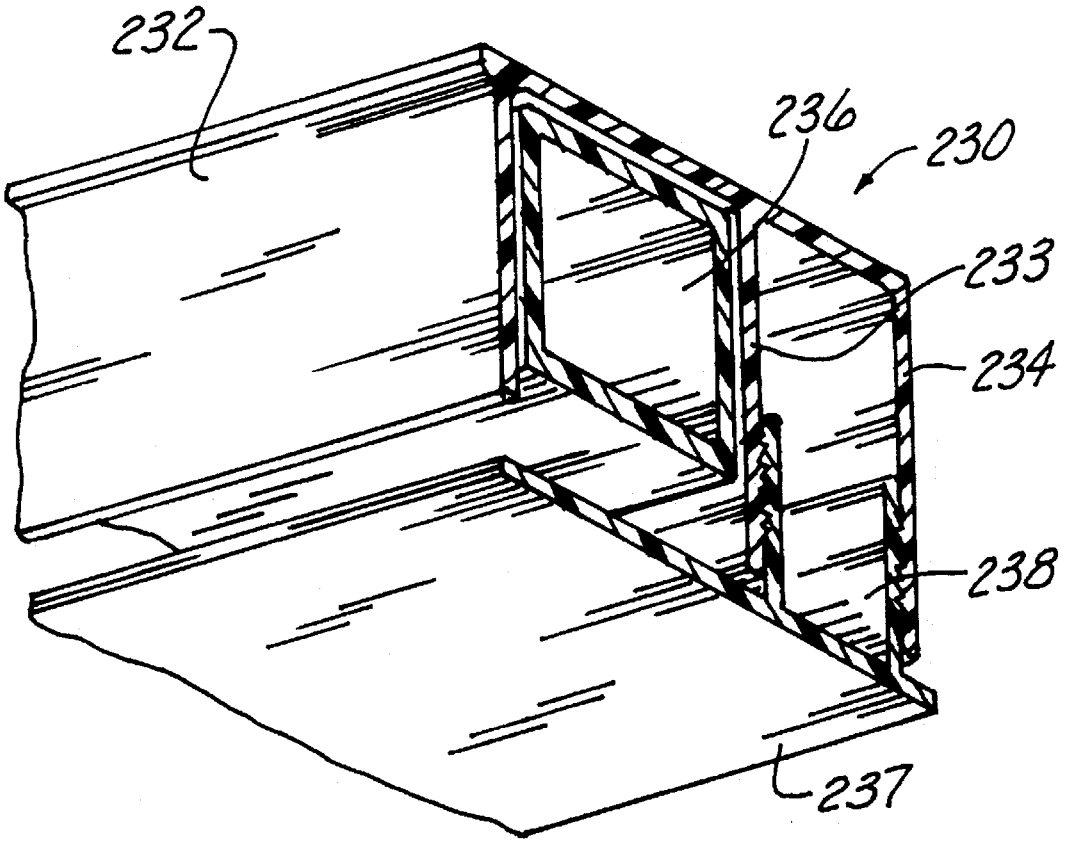
FIG. 15 is a perspective cross-sectional view of the connecting structure of FIG. 14.

Another alternate connector (230) is shown in FIGS. 14 and 15. The connector (230) includes a base portion (231) having three spaced apart portions (232) and (233) and (234) forming grooves between adjacent spaced about portions. The spaced apart portions (233) and (234) have longitudinal ridges (235) on the inside surface thereof. A support member (236), as can readily be seen in FIGS. 14 and 15 fits between portions (232) and (233). The lower fiberglass mat (16) extends around the holding member (236) and in the groove between leg portions (232) and (233).

The lower fiberglass mat (16) (not shown in FIGS. 14 and 15) has a lower water impermeable facing (19) adhered thereto and this is all compressed into the groove between portions (232) and (234) to provide an attractive trim for the end of the lower strip of insulation (16). This member (237) also has projecting portions (238) thereon and longitudinal projections on the outside thereof for cooperating with, and in some instances mating with, the longitudinal ridges and grooves (235) inside of groove between portions (233) and (234).

Accordingly, it will be appreciated that the apparatus shown and described has indeed accomplished the aforementioned objects. Obviously, many modifications and variations of the present invention are possible in light of the above teachings. It is therefore to be understood that, within the scope of the appended claims, the invention may be practiced otherwise than as specifically described.

I claim:

1. Apparatus for connecting one end of a strip of insulation to a building comprising:

an elongated connector member adapted to be attached to the inside of a building to be insulated, said elongated connector member including first, second, and third spaced apart portions connected together at the base of each spaced apart portion and having respective free ends thereby providing a first groove disposed in said elongated connector member between said first and second spaced apart portions and a second groove disposed in said elongated connector member between said second and third spaced apart portions;

an elongated holding member received in said first groove between said first and second spaced apart portions for holding one end of a strip of insulation in said groove; and a cap extending at least partially over said first and second grooves, a portion of said cap being removably disposed in said second groove and operably attached to at least one of said second and third spaced apart portions.

2. The apparatus of claim 1 including an elongated locking member disposed in said second groove for locking said holding member into said groove.

3. The apparatus of claim 2, the interior of said second and third spaced portions have longitudinal ridges along the length of the groove and wherein at least a portion of said locking member disposed in said second groove has ridges thereon for cooperation with the longitudinal ridges in the second groove of said elongated connector member.

4. The apparatus of claim 1 wherein said first groove is larger at the base of said two spaced apart portions of the elongated connector member than at the free ends thereof.

* * * * *